United States Patent [19]

Peel et al.

[11] 4,368,685

[45] Jan. 18, 1983

[54] WIPING OF TREATED WIRE OR STRIP

[76] Inventors: Colin D. Peel; Colin Gin, both of Beach Rd., Auckland, New Zealand

[21] Appl. No.: 327,786

[22] Filed: Dec. 7, 1981

[51] Int. Cl.[3] ..... C23C 1/00

[52] U.S. Cl. ..... 118/109; 118/125; 118/DIG. 18; 427/357; 427/433; 428/357

[58] Field of Search ..... 118/125, DIG. 18, 109; 72/274, 467; 76/107 A; 427/357, 433; 428/357

[56] References Cited

U.S. PATENT DOCUMENTS 2,914,423 11/1959 Knapp ..... 427/357
4,269,887 5/1981 Sonobe et al. ..... 428/280

FOREIGN PATENT DOCUMENTS 33040 8/1981 European Pat. Off. .
103929 2/1974 German Democratic Rep. .

*Primary Examiner*—James C. Cannon
*Attorney, Agent, or Firm*—Abelman, Frayne & Rezac

[57] ABSTRACT

A pad for the wiping of coated wire or strip and a method of forming such a pad. The pad includes a compressed non-combustible, alumino silicate fibrous material.

The method of forming the pad wiping material includes compressing such an alumino silicate fibrous material into a pad by the application of pressure in the range of 7 to 20 tonnes per square inch.

4 Claims, No Drawings

WIPING OF TREATED WIRE OR STRIP

This invention relates to the wiping of a metal coating applied to a wire or strip.

The invention has particular, although not exclusive application to the wiping of a coating as zinc or strip emerges from a bath of molten metal such as zinc, or some other suitable metal coating material.

Up until this time, in the galvanising of wire or coating of wire, the wire or strip has been taken from the bath at a shallow angle to the horizontal and wiped with an asbestos pad or asbestos string.

In one case of asbestos string, the asbestos string is wound round the wire and the wire passed through a slot between a pair of fingers, so that the string is wedged into the slot, thus wiping the surface of the wire or strip. In the case of pads these have generally been formed by hand, by winding asbestos card into a pad or disc, the pad or disc then being placed in a suitable pad holder.

It is an object of this invention to go someway towards providing an improved material for the wiping of coated wire or strip and to at least provide the public and manufacturers with a useful choice.

Other objects will become apparent from the following description.

According to one aspect of this invention, there is provided a pad for the wiping of coated wire or strip emerging from a bath of molten metal, characterised in that said pad includes alumino silicate fibrous material, having been compressed by the application of pressure.

According to a further aspect of this invention, there is provided a method for forming a pad for the wiping of coated wire or strip, including the steps of:

(1) Taking an amount of alumino silicate fibrous material;

(2) Compressing said alumino silicate fibrous material into a pad by the application of pressure, and thereafter (3) Using said pad for the wiping of coated wire or strip emerging from a bath of molten metal.

This invention will now be described by way of example only, and it should be appreciated that modifications and improvements may be made to the invention without departing from the scope or spirit thereof.

It has been found in experimentation, that a compressed non-combustible material has particular advantages in the wiping of wire or strip, which has been coated with a suitable coating such as zinc, or some other metal coating material during the processing of wire or strip.

The compression takes place within or by way of a suitable press, (not shown) of a known type, at a pressure in the range of about 7 to 20 tonnes per square inch.

In one form of the invention, the press consists of a piston moving within a tubular member or housing of a cross section corresponding substantially to that of the resulting pads.

The applied pressure or pressure applied to the pads will vary depending upon the size of the wire to be wiped, and hence the ability of the pad to wrap around the wire on the other hand the ability of the pad to remain as an integral unit during wiping.

When compacted, the non-combustible material is caused to remain as an integral unit during wiping.

For large diameter wires, the pads are preferably softer (that is to say compressed at a lower pressure) than would be the case for pads suitable for small diameter wires.

In use, it has been found that a lubricant, for example powdered graphite, may be required at the beginning of a wiping operation, that is to say, when the wire or strip begins to pass through or past the pad.

However, the graphite material will function as a lubricant for the passage of wire or strip through or by the pad or pads.

In the preferred form of the invention, a pad is formed or includes an alumino silicate fibrous material.

It has been found that by using an alumino silicate fibrous material, which is compressed into a pad by an applied pressure in the range of about 7 to about 20 tonnes per square inch, there are a number of advantages.

By way of example the advantages are:

1. The use of alumino silicate fibrous material removes or at least reduces health hazards which might be present by using the asbestos material as described hereinbefore by way of example.

2. It has been found during experimentation that the use of alumino silicate fibrous material, as a pad wiping material enables the pad wiping material to withstand temperatures generally higher than asbestos material. For example it has been found that alumino silicate fibrous material can generally withstand high temperatures (such as found during wiping operations) of up to approximately 1300° C.

3. The use of alumino silicate fibrous material as a pad wiping material has generally been found to give a longer and high pad life than other wiping materials (such as asbestos).

4. By using alumino silicate fibrous material as a pad wiping material, it has been found that a more even wipe is obtained over the wire or strip, than is generally obtained by using other materials (such as asbestos).

5. The use of alumino silicate fibrous material results in a tighter wipe about the wire or strip, and generally speaking results in a low coating thickness as compared with other materials. The use of alumino silicate fibre is therefore somewhat more economic than other materials.

As stated hereinbefore the non-combustible alumino silicate fibrous material is compressed into a unit by pressure in the range of 7 to 20 tonnes per square inch, so as to result in a compressed pad or disc which is able to be used for the wiping of coated wire or strip.

It should therefore be appreciated that improvements or modifications to this invention may be made without departing from the scope thereof, as defined by the appended claims.

We claim:

1. A pad for the wiping of coated wire or strip emerging from a bath of molten metal, characterised in that said pad includes alumino silicate fibrous material, having been compressed by the application of pressure.

2. A pad as claimed in claim 1, wherein said alumino silicate fibrous material has been compressed by the application of pressure in the range of 7 to 20 tonnes per square inch.

3. A method for forming a pad for the wiping of coated wire or strip, including the steps of:

(1) Taking an amount of alumino silicate fibrous material;

(2) Compressing said alumino silicate fibrous material into a pad by the application of pressure, and thereafter (3) Using said pad for the wiping of coated wire or strip emerging from a bath of molten metal.

4. A method as claimed in claim 3, wherein the alumino silicate fibrous material is compressed into a pad by the application of pressure in the range of 7 to 20 tonnes per square inch.

* * * * *